US007346968B2

(12) United States Patent
Cano et al.

(10) Patent No.: US 7,346,968 B2
(45) Date of Patent: Mar. 25, 2008

(54) METHOD AND APPARATUS FOR CONNECTING LOOPS OF BARBED TAPE TO EACH OTHER

(76) Inventors: Steven John Cano, 3636 W. Buckeye Rd., Phoenix, AZ (US) 85009; Renne Cano, 3636 W. Buckeye Rd., Phoenix, AZ (US) 85009

( * ) Notice: Subject to any disclaimer, the term of this patent is extended or adjusted under 35 U.S.C. 154(b) by 17 days.

(21) Appl. No.: 11/062,710

(22) Filed: Feb. 22, 2005

(65) Prior Publication Data

US 2006/0185138 A1 Aug. 24, 2006

(51) Int. Cl.
*B21F 25/00* (2006.01)

(52) U.S. Cl. ..... 29/7.3; 29/7.1; 29/432; 29/566; 140/59; 140/65

(58) Field of Classification Search ..... 29/7.1, 29/7.2, 7.3, 432, 566; 140/2, 58, 59, 61, 140/65; 256/2, 47
See application file for complete search history.

(56) References Cited

U.S. PATENT DOCUMENTS 390,975 A * 10/1888 Jordan et al. ..... 29/7.1
2,507,903 A * 5/1950 Grounds ..... 242/392
2,945,512 A * 7/1960 Puckett ..... 140/2
3,070,946 A * 1/1963 Kirsch et al. ..... 57/1 R
3,152,770 A * 10/1964 Myers ..... 242/470
3,252,723 A * 5/1966 Burke ..... 289/1.5
4,484,729 A * 11/1984 Mainiero et al. ..... 256/1
4,903,384 A * 2/1990 Lange ..... 29/7.1
4,955,118 A * 9/1990 Lange ..... 29/7.1
5,109,583 A * 5/1992 Pavlov ..... 29/7.1
2006/0010677 A1* 1/2006 Pavlov ..... 29/432
2006/0022185 A1* 2/2006 Pavlov ..... 256/5
2006/0214148 A1* 9/2006 Major et al. ..... 256/8

* cited by examiner

*Primary Examiner*—Essama Omgba
(74) *Attorney, Agent, or Firm*—Etherton Law Group, LLC

(57) ABSTRACT

A method and apparatus for automatically attaching loops of a coil together at desired points. The apparatus comprises a frame, a rotatable barrel, wire separators, alignment fingers, a clipping rack further comprising pincers, and a clipping gun. The barrel, wire separators and fingers cooperate to attach the alternate loops together at desired points. The barrel is driven by a stepper motor to rotate a specific distance about a central axis. The wire separators, pincers, and clipping gun are driven pneumatically. The motor and pneumatics are controlled electronically.

17 Claims, 7 Drawing Sheets

METHOD AND APPARATUS FOR CONNECTING LOOPS OF BARBED TAPE TO EACH OTHER

FIELD OF INVENTION

This invention relates to a method and apparatus for deforming metal, specifically modifying barbed tape into concertina.

BACKGROUND

Coiled barbed tape has long been known as a barrier. It is essentially a coil of steel wire that has razor blades attached every few feet. Each portion of the coil that forms a 360 degree circle is called a "loop" herein. For increased strength and improved ease of handling, the loops of barbed tape can be connected to each other at staggered points. The material having connected loops is referred to herein as concertina, to distinguish it from a coil of barbed tape in which the loops have not been connected, referred to herein as simply a coil.

Historically, concertina is made by loading a coil of barbed steel wire onto a frame that rotates about a central axis. Then a man grabs a first loop of the coil and manually pinches it to the previous loop of the coil while simultaneously using a pneumatic gun to wrap a metal strip around the coils to attach them together. The metal strip is known in the art as a clip. Then, the man rotates the frame a given amount and grabs the first loop of the coil and clips it to the subsequent loop of the coil. The process results in alternate loops being attached to each other. This clipping-and-rotating is repeated until the entire coil is attached at desired points along the entire length of the coil. Loops attached five times are known as "5-clip" concertina in the art; "3-clip," "7-clip" and "9-clip" configurations are also known in the art.

The conventional manual method of making concertina is dangerous and slow. The barbs are literally as sharp as razor blades and therefore will easily slice through skin. The steel coil is under tension due to the helix configuration (like a Slinky®) and therefore difficult to handle. Further, even a short coil of barbed steel wire is very heavy.

Therefore, it is an object of this invention to provide a faster and easier method and apparatus for clipping coils of barbed tape together to form concertina. It is another object to provide such method and apparatus to automate the connection of the loops of the coil of barbed tape.

SUMMARY OF THE INVENTION

The present invention is a method and apparatus for automatically attaching loops of a coil of barbed tape together at desired points. The preferred embodiment of the apparatus comprises a rotatable barrel, wire separators, a clipping assembly further comprising pincers and alignment fingers and a clipping gun. The components cooperate to attach the loops together at desired points. The barrel is driven by a stepper motor to rotate a specific distance about a central axis. The wire separators, fingers, pincers, and clipping gun are driven pneumatically. The motor and pneumatics are controlled with electronic switches.

DETAILED DESCRIPTION OF THE INVENTION

Figure 1:
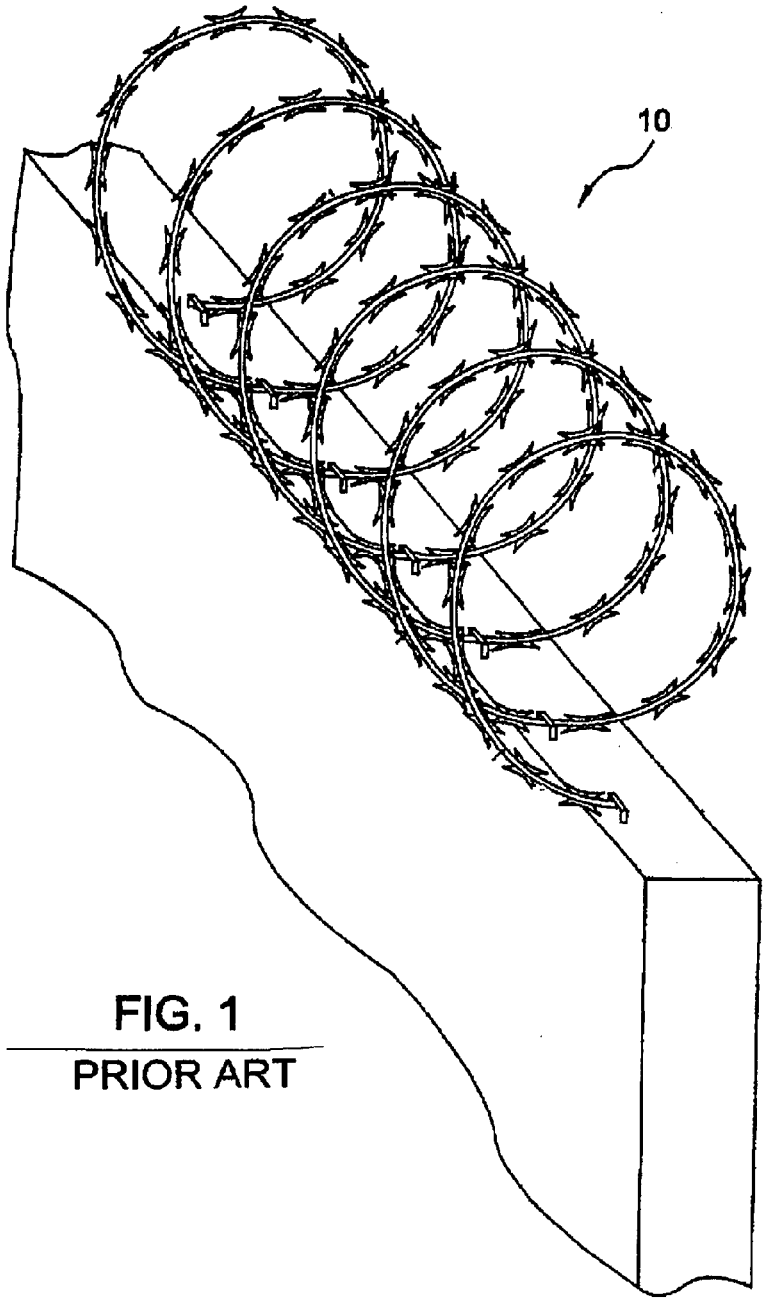
FIG. 1 PRIOR ART
FIG. 1 illustrates a coil of barbed wire of the prior art that has been expanded to form a barrier.
Figure 2:
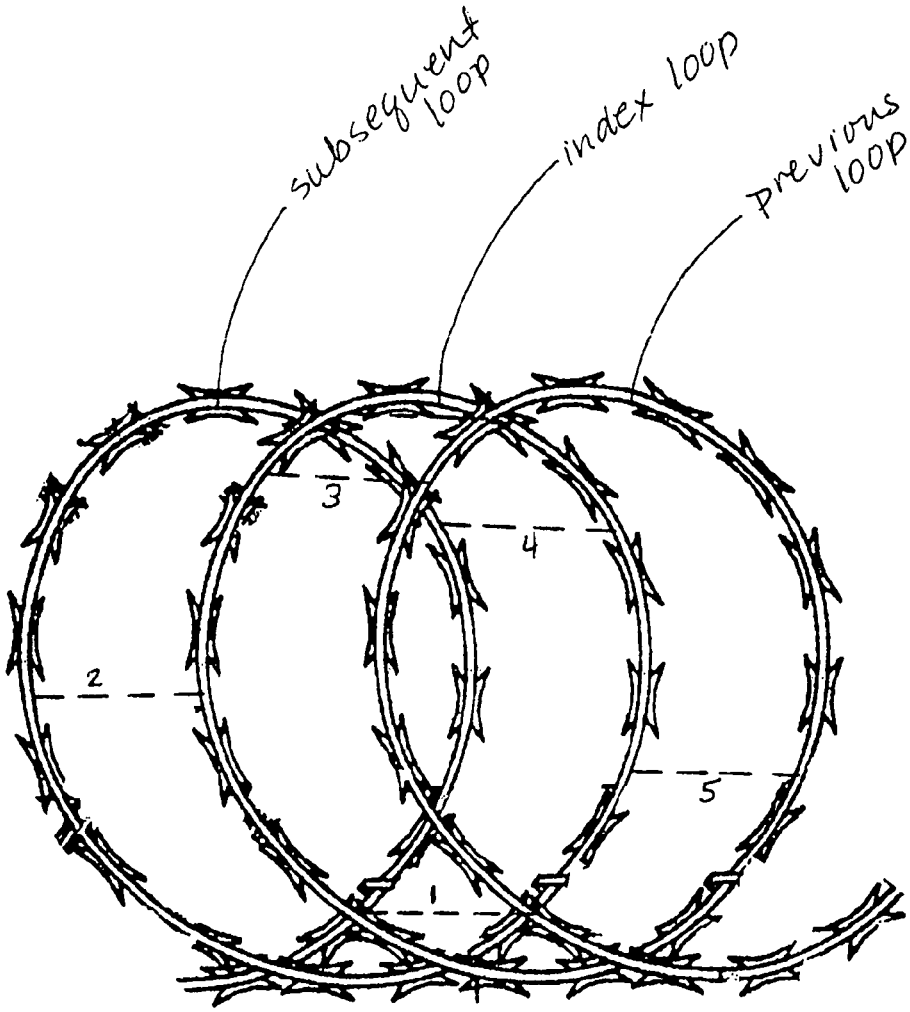
PRIOR ART FIG. 2
FIG. 2 is a schematic illustration of a portion of coil and the attachment points of "5-clip" concertina.

FIG. 1 illustrates a coil 10 of barbed tape of the prior art that has been expanded to form a barrier. FIG. 2 is a schematic illustration of a portion of coil 10, namely three loops: the index loop, the loop previous to it and the loop subsequent to it. The dotted lines indicate where the loops will be attached to each other. The index loop is attached to the previous loop at attachment points 1, 3 and 5 and to the subsequent loop at attachment points 2 and 4. For clarity of illustration, only the attachment points in the index loop are shown; the previous loop and the subsequent loop would have additional attachment points with their neighbors, if the coil was shown in its entirety.

Figure 3:
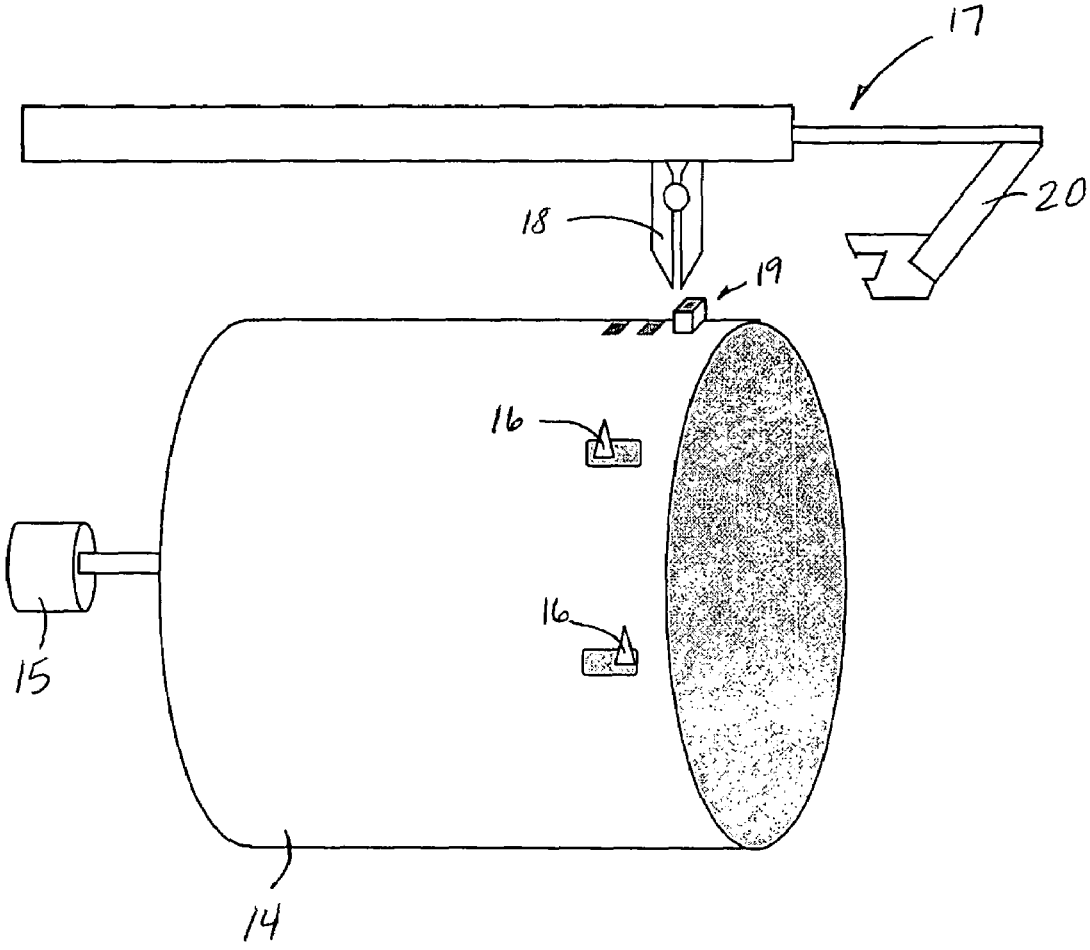
FIG. 3 illustrates a left side view of the apparatus.

FIG. 3 illustrates a left side view of the preferred embodiment of the apparatus. The apparatus comprises a barrel 14, wire separators 16, a clipping rack 17 further comprising pincers 18 and alignment fingers 19, and a clipping gun 20. The barrel 14 is rotated around its lengthwise axis by a motor 15. The motor 15 is capable of rotating the barrel a specific distance so that a desired point on each loop can be positioned under the pincers 18. The preferred embodiment employs a stepper motor that is controlled electronically, as is known in the art.

Each wire separator 16 extends through an aperture in the barrel 14 and can be retracted into the barrel 14. Each wire separator 16 is moveable from one side of the aperture to the other. Preferably the wire separators are operated pneumatically and the pneumatics are controlled electronically. Alternatively, the wire separators may be operated mechanically or electronically.

Figure 4:
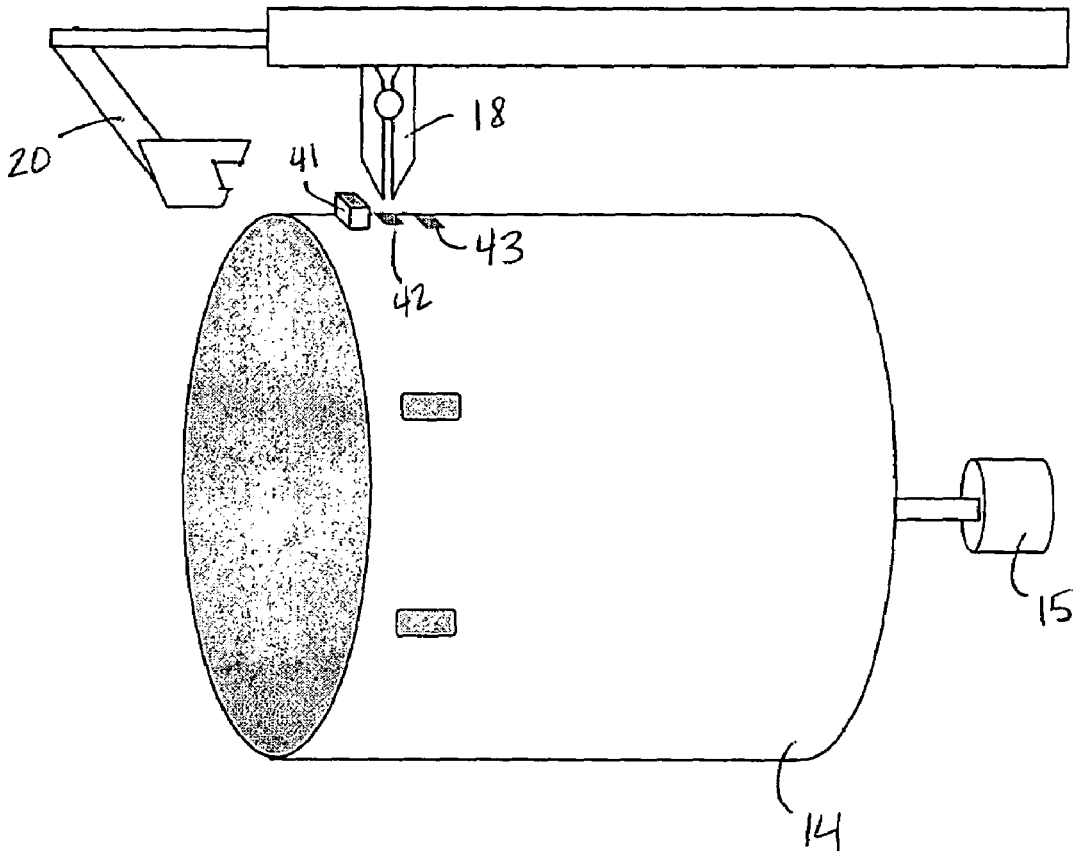
FIG. 4 illustrates a right side view of the apparatus.

FIG. 4 illustrates a right side view of the apparatus to more clearly show the alignment fingers, namely the outer finger 41, the mid finger 42, and the back finger 43. The alignment fingers 19 extend and retract through apertures in the barrel 14. As with the separators, preferably the alignment fingers are operated pneumatically, and the pneumatics are controlled electronically. Alternatively, the fingers may be operated mechanically or electronically.

Figure 5:
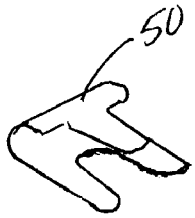
FIG. 5 shows a perspective view of a clip.
Figure 6:
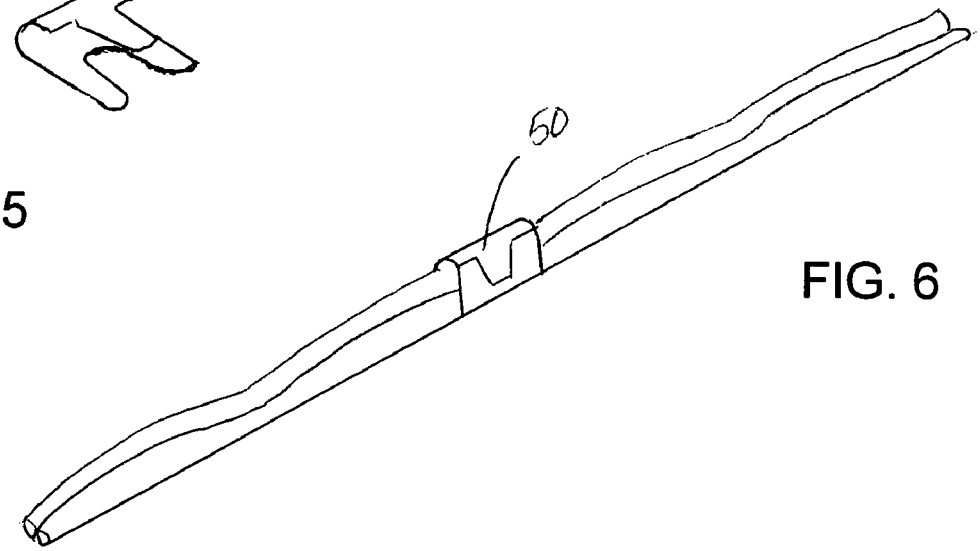
FIG. 6 shows a perspective view of portions of two loops clipped together.

The loops of the coil are attached at desired points. The preferred embodiment attaches each loop five times, although the loops may be attached as many times as desired, for example to create 3-clip or 7-clip concertina. The attachment has to be robust to withstand the forces tending to pull the loops apart, inherently from the helix structure but also as the concertina is expanded to form a barrier. The loops can be attached together in several ways. The preferred embodiment uses a clip 50, as shown in FIG. 5. FIG. 6 shows portions of two loops clipped together. In the preferred embodiment, the clips are applied to the loops using a pneumatic clipping gun 20. Clipping guns are available commercially from fencing suppliers. The loops may be attached in other ways, for example by welding, riveting, or crimping, each way using an attachment device specific to the way the loops are fastened to each other. For example, the attachment device for a weld would be a welder; a rivet gun for a rivet; or a crimper for crimping the loops together, all of which are available commercially.

Figure 7:
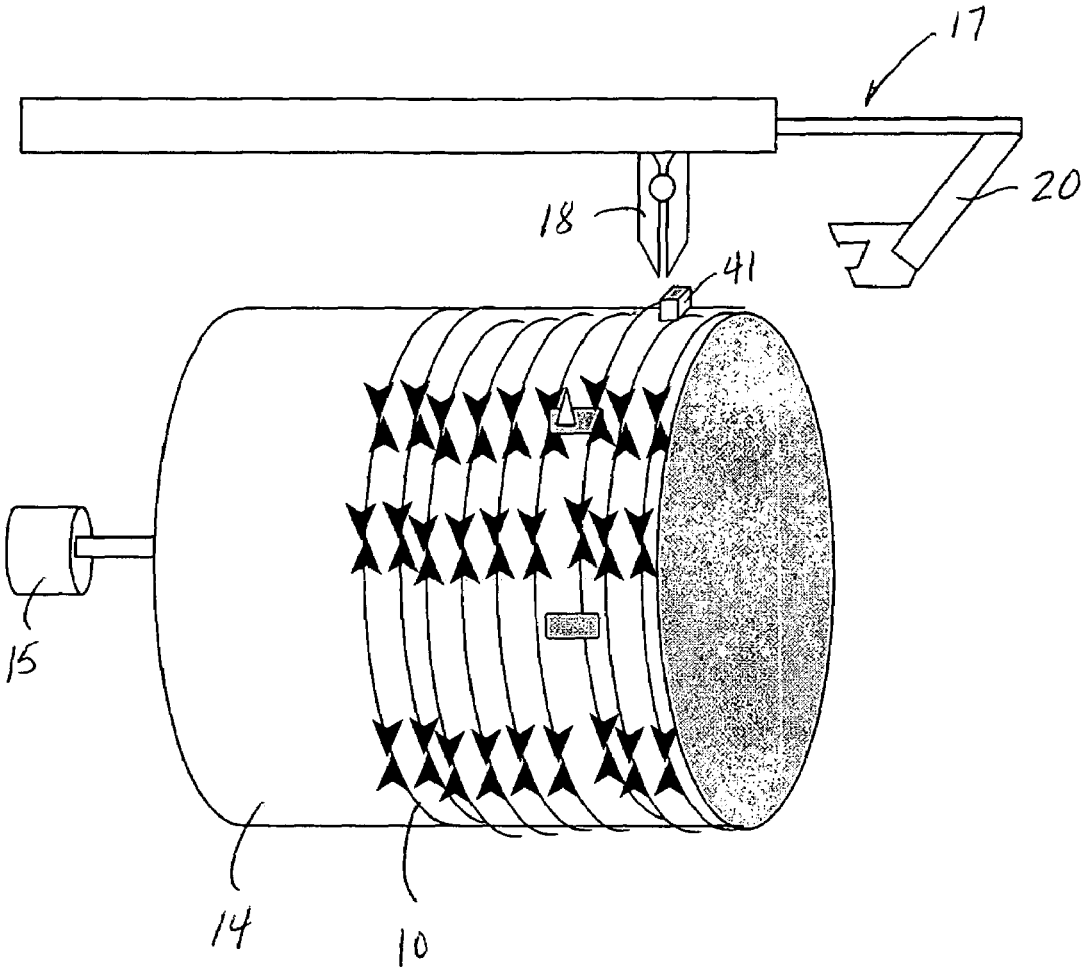
FIG. 7 illustrates a left side view of the apparatus with a coil loaded onto the barrel.

To attach the loops together, a coil 10 is loaded onto the barrel 14. See FIG. 7. Once the coil 10 is loaded, the first two loops to be attached are aligned under the pincers 18. The alignment is accomplished by the interaction and cooperation of the wire separators 16 and the alignment fingers 19, depending on which loops are to be attached. It is convenient to think of the attachment taking place over three loops at a time as illustrated in FIG. 2: an index loop, the loop previous to it, and the loop subsequent to it. To attach all the loops of an entire coil, each loop incrementally becomes the index loop, until each of all loops has been attached to its neighbors at the desired points.

Each wire separator 16 extends from its aperture at the appropriate side of the aperture to limit the movement of each loop and thus guide each loop in a desired direction along the axis of the barrel. Similarly, each of the alignment fingers extends and retracts through its aperture in the barrel to limit the movement of each loop and thus guide each loop in a desired direction along the lengthwise axis of the barrel. The result is that the appropriate loops can be aligned under the pincers 18 to be attached to each other. The alignment fingers 19 also lift the loops to be attached, as explained below.

In one embodiment, the index loop and loop previous to it are selected and guided with the wire separators to pass under the pincers. Using at least one electronically-controlled alignment finger, the loops are aligned under pincers at the first desired attachment point on the coil. The index loop and previous loop are attached together by first pinching the loops together with the pincers then clipping them together with the clipping gun. This attachment routine for a clipping gun is defined in more detail below. The barrel is then rotated a given distance to align the loops under the pincers at a second desired point. This rotating, aligning and attaching is repeated until all the loops are attached to their neighbors.

Figure 8:
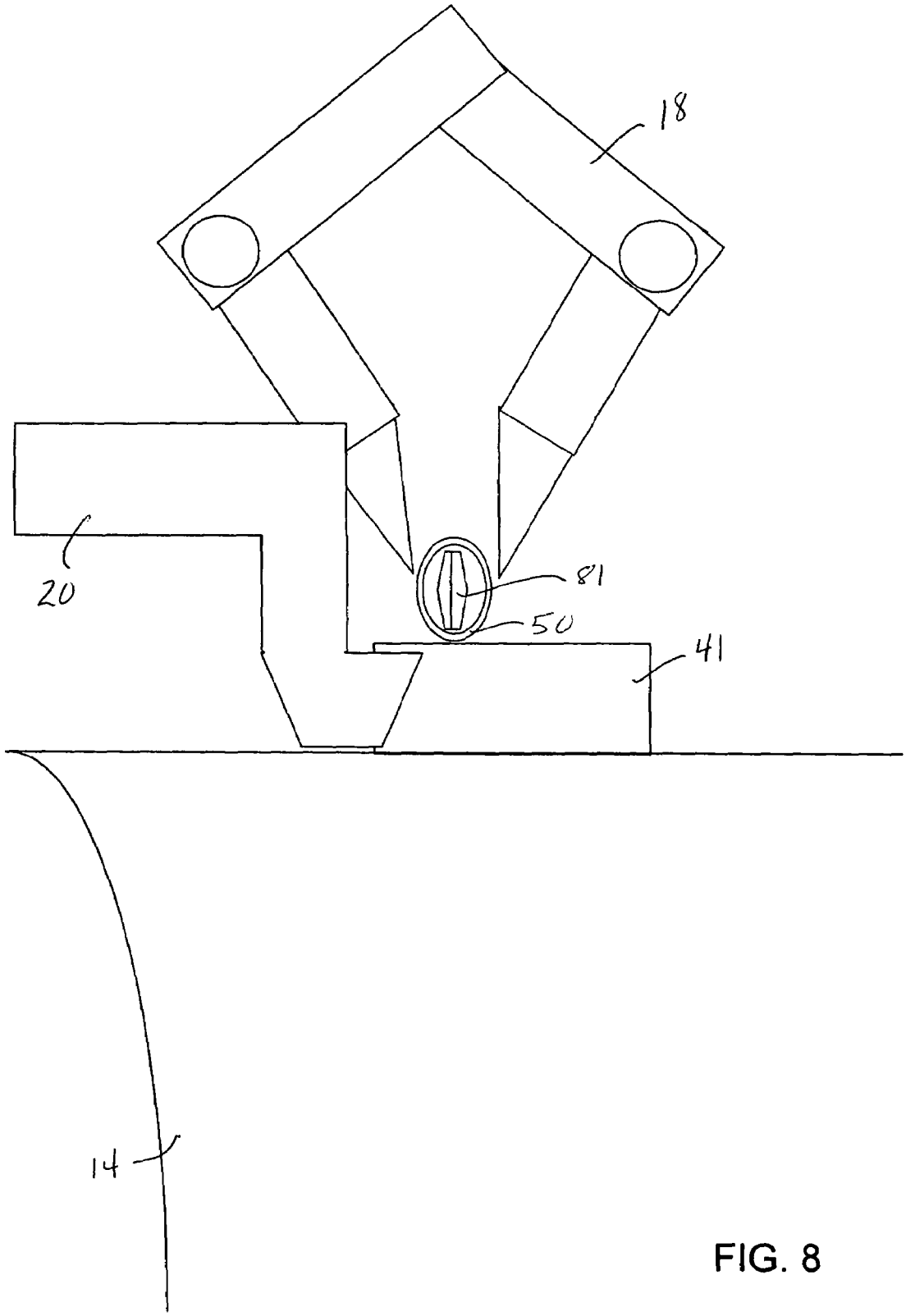
FIG. 8 shows is a detailed right side view of the clipping assembly, showing two loops clipped together.

In order to use a clipping gun 20 as the attachment device, the loops have to be raised off the barrel so that the jaw of the clipping gun 20 can get under the loops to grasp them. In essence, the attachment routine lift the loops off the barrel, clips them, then lowers the now-clipped loops back to the barrel. This lifting and lowering is accomplished by extending one of the alignment fingers from the barrel to lift the loops off the barrel. Then the pincers are opened, lowered over the loops, and closed on the loops to securely hold them. Then the clipping gun is moved into position so that the jaw of the clipping gun 20 can grasp the raised loops. The clip is attached, clipping gun retracted, pincers opened, and the finger retracted, leaving the now-clipped loops resting on the barrel. Which loops are being attached will determine their position relative to the fingers and therefore which finger needs to be raised to lift the loops of the barrel. FIG. 8 shows the outer finger 41 lifting the now-clipped loops 81 off the barrel 14. The clipping gun 20 is retracted and the pincers 18 are opening to release the loops 81. Timing electronics cause these actions to be coordinated.

The attachment at the desired points takes place in any order. For example, the previous loop and index loop can be attached at one point, followed by attachment of the index loop and the subsequent loop at a second desired point, followed by attachment of the previous loop and the index loop again at a third desired point. This would require selecting, aligning, and rotating after each attachment. However, once the loops are attached to each other at even one point, it becomes more difficult to separate the loops from each other and select them for attachment. It is easier to separate the loops away from an attachment point that nearer to one. For this reason, wire separators are spaced around the circumference of the barrel to enable the selection and guiding to occur at different distances from an attachment point. It has been found to be most efficient, therefore, to attach all points on a given pair of loops before selecting a second pair of loops. Thus, the preferred embodiment attaches all the desired points on the previous loop and the index loop before moving on to attach all the desired points on the index loop and the subsequent loop. A specific example is illustrative:

EXAMPLE 1

Attaching Loops in a 5-clip Configuration

Rotate the barrel to a first desired attachment point; extend a first wire separator from the barrel to select and guide the first pair of loops (namely the index loop and the one previous to it); and execute the attachment routine, as described above, on the first pair of loops at the first desired point, using the mid finger to lift the loops;

Rotate the barrel to a third desired attachment point and when the clip is behind the first wire separator, retract the mid finger and extend a second wire separator from the barrel to select and guide the first pair of loops; execute the attachment routine on the first pair of loops at the second desired point, using the mid finger to lift the loops;

Rotate the barrel to a fifth desired attachment point and when the clip is behind the second wire separator, retract the mid finger and extend a third wire separator from the barrel to select and guide the first pair of loops; execute the attachment routine on the first pair of loops at the third desired point, using the mid finger to lift the loops;

Select a second pair of loops (namely the index loop and the one subsequent to it) by extending the outer finger from the barrel; shift the first wire separator to the other side of its aperture and extend it from the barrel to select and guide the second pair of loops;

Rotate the barrel to the starting point and when the clip is behind the third wire separator, retract the mid finger.

At this point the barrel has made one 360° rotation.

Rotate the barrel to a second desired attachment point; extend a fourth wire separator from the barrel to select and guide the second pair of loops, execute the attachment routine on the first pair of loops at the third desired point, using the mid finger to lift the loops;

Shift wire separator to the other side of its aperture to select and guide the second pair of loops;

Rotate the barrel to a fourth desired attachment point and when the clip is behind the fourth wire separator, retract the outer finger and extend the second wire separator from the barrel to select and guide the second pair of loops; execute the attachment routine on the second pair of loops at the fourth desired point, using the outer finger to lift the loops;

Rotate the barrel to the starting point and repeat the process for the next set of loops.

While there has been illustrated and described what is at present considered to be a preferred embodiment of the present invention, it will be understood by those skilled in the art that various changes and modifications may be made, and equivalents may be substituted for elements thereof without departing from the true scope of the invention. Therefore, it is intended that this invention not be limited to the particular embodiment disclosed as the best mode contemplated for carrying out the invention, but that the invention will include all embodiments falling within the scope of the appended claims.

We claim:

1. A method for automatically attaching neighboring loops of a coil together at a plurality of desired points, the method comprising:

a. loading a coil of wire onto a rotatable barrel, wherein the coil of the wire comprises an index loop, a previous loop, and a subsequent loop, and the barrel is rotated with a motor;

b. aligning the index loop and the previous loop at a first desired point and attaching the index loop and previous loop together at the first desired point;

c. rotating the barrel from the first desired point to a second desired point;

d. aligning the index loop and the subsequent loop at the second desired point and attaching the index and second loops together at the second desired point;

e. repeating steps b-d until each of the loops in the coil has been attached to its neighboring loops.

2. The method of claim 1 wherein attaching is performed by an attachment device in cooperation with pincers, both of which are controlled electronically.

3. The method of claim 2 wherein the pincers are pneumatically driven.

4. The method of claim 2 wherein the attachment device is a clipping gun.

5. The method of claim 4 wherein the clipping gun is pneumatically driven.

6. The method of claim 2 wherein the attachment device is a welder.

7. The method of claim 2 wherein the attaching comprises:

a. aligning an alignment finger under the index loop and previous loop and extending the alignment finger from the barrel to lift the index loop and previous loop off the barrel;

b. opening pincers, lowering pincers over the loops, and closing pincers on the loops to securely hold them;

c. lowering an attachment device over the loops so that the attachment device can access the raised loops;

d. attaching the loops;

e. retracting the attachment device, opening the pincers; retracting the alignment finger such that the loops rest on the barrel.

8. The method of claim 1 wherein the aligning is performed by at least one alignment finger that is controlled electronically.

9. The method of claim 8 wherein the alignment finger is retracted into and extended from the rotatable barrel pneumatically.

10. A method for automatically attaching neighboring loops of a coil together at desired points, the method comprising:

a. loading a coil of wire onto a rotatable barrel, wherein the coil of the wire comprises an index loop, a previous loop, and a subsequent loop, and the barrel is rotated with a stepper motor;

b. attaching the index loop and previous loop together at a first plurality of desired points by:

i. selecting the index loop and the previous loop using at least one electronically-controlled wire separator;

ii. aligning the index loop and the previous loop under pincers at one of the first plurality of desired points using at least one electronically-controlled alignment finger;

iii. attaching the index loop and previous loop together at one of the first plurality of desired points with an attachment device;

iv. rotating the barrel from a first desired point to another of the first plurality of desired points; and c. repeating steps i-iv until the index loop and previous loop are attached at each of the first plurality of desired points;

d. attaching the index loop and the subsequent loop together at a second plurality of desired points by:

i. selecting the index loop and the subsequent loop using at least one electronically-controlled wire separator;

ii. aligning the index loop and the subsequent loop under pincers at one of the second plurality of desired points using at least one electronically-controlled alignment finger;

iii. attaching the index loop and previous loop together at one of the second plurality of desired points with the attachment device;

iv. rotating the barrel from a first desired point of the second plurality of desired points to another desired point of the second plurality of desired points; and e. repeating steps v-viii until the index loop and subsequent loop are attached at each of the second plurality of desired points;

f. repeating steps c and e until each of the loops in the coil has been attached to its neighboring loops.

11. The method of claim 10 wherein the pincers are pneumatically driven.

12. The method of claim 10 wherein the attachment device is a clipping gun.

13. The method of claim 10 wherein the attachment device is a welder.

14. The method of claim 10 wherein the alignment finger is retracted into and extended from the rotatable barrel pneumatically.

15. An apparatus for automatically attaching neighboring loops of a coil together at desired points, the apparatus comprising:

a. a rotatable barrel driven by a motor, the barrel supporting the coil;

b. at least one electronically-controlled wire separator attached to the barrel;

c. a clipping assembly comprising i. at least one alignment finger attached to the barrel;

ii. pincers positioned to be moved into contract with the loops of the coil; and iii. a device for attaching the loops of the coil together, positioned to be moved into contact with the loops of the coil;

d. wherein the loops of the coil are selected and guided by the wire separators and are attached to each other at desired points with the clipping assembly as the barrel rotates.

16. The apparatus of claim 15 wherein the device for attaching the loops of the coil together is a pneumatic clipping gun.

17. The apparatus of claim 15 wherein the device for attaching the loops of the coil together is a welder.

* * * * *